US006547366B2

(12) United States Patent
Sharma et al.

(10) Patent No.: US 6,547,366 B2
(45) **Date of Patent: *Apr. 15, 2003**

(54) CLEANING METHOD FOR NOZZLE PLATE OF AN INK JET PRINT HEAD

(75) Inventors: Ravi Sharma, Fairport, NY (US); Zhihao Yang, Webster, NY (US); Kenneth R. Shull, Evanston, IL (US)

(73) Assignee: Eastman Kodak Company, Rochester, NY (US)

( * ) Notice: Subject to any disclaimer, the term of this patent is extended or adjusted under 35 U.S.C. 154(b) by 2 days.

This patent is subject to a terminal disclaimer.

(21) Appl. No.: 09/739,419

(22) Filed: Dec. 18, 2000

(65) Prior Publication Data

US 2002/0075347 A1 Jun. 20, 2002

(51) Int. Cl.[7] ..... B41J 2/165
(52) U.S. Cl. ..... 347/22; 347/29
(58) Field of Search ..... 347/22, 28, 29, 347/32, 36, 102, 104, 106; 510/170–174; 134/4, 198; 400/701; 101/425

(56) References Cited

U.S. PATENT DOCUMENTS

| | | | | | |
|---|---|---|---|---|---|
| 4,645,555 | A | * | 2/1987 | Kuboyama | 156/234 |
| 4,812,488 | A | * | 3/1989 | Koleske et al. | 522/31 |
| 5,399,620 | A | * | 3/1995 | Niessner et al. | 525/71 |
| 5,400,060 | A | * | 3/1995 | Carlotta | 347/29 |
| 5,801,743 | A | | 9/1998 | Itoh et al. | 347/171 |
| 5,905,099 | A | * | 5/1999 | Everaerts et al. | 522/126 |
| 6,145,952 | A | | 11/2000 | Sharma et al. | 347/22 |
| 6,151,044 | A | | 11/2000 | Gaasch | 347/33 |
| 6,386,679 | B1 | * | 5/2002 | Yang et al. | 347/45 |

FOREIGN PATENT DOCUMENTS

| | | | | | |
|---|---|---|---|---|---|
| EP | 0 638 426 | A1 | | 2/1995 | |
| JP | 58007378 | | | 1/1983 | |
| JP | 59162075 | | | 9/1984 | |
| JP | 405084925 | A | * | 4/1993 | 347/29 |
| JP | 406023998 | A | * | 1/1994 | 347/22 |

* cited by examiner

*Primary Examiner*—Shih-Wen Hsieh
(74) *Attorney, Agent, or Firm*—Harold E. Cole

(57) ABSTRACT

A method for removing contaminants from an ink jet print head having a nozzle plate with a plurality of nozzles, having the steps of: a) applying a heat-activatable adhesive material over the surface of the nozzle plate having contaminants on the surface thereof; b) applying heat to the heat-activatable to the adhesive material to cause it to flow over the surface of the nozzle plate having contaminants on the surface thereof, thereby causing the contaminants to adhere to the heat-activatable adhesive material; and c) removing the heat-activatable adhesive material having the contaminants adhered thereto.

6 Claims, 4 Drawing Sheets

CLEANING METHOD FOR NOZZLE PLATE OF AN INK JET PRINT HEAD

FIELD OF THE INVENTION

This invention relates to a cleaning method for a nozzle plate of an ink jet print head to remove contaminants from the surface thereof.

BACKGROUND OF THE INVENTION

Ink jet printers are well known in the printing industry. Ink jet printers are just one of many different types of printing systems that have been developed which include laser electrophotographic printers, LED electrophotographic printers, dot matrix impact printers, thermal paper printers, film recorders, thermal wax printers and dye diffusion thermal transfer printers. Ink jet printing has become recognized as a prominent contender in the digitally controlled, electronic printing industry because of its non-impact, low-noise characteristics, its use of plain paper and its avoidance of toner transfers and fixing.

There is a problem with ink jet printers in that dirt or other contaminants from paper or the atmosphere clog the nozzles of the nozzle plate causing misdirected ink drops or malfunctioning nozzles, which adversely affect the image quality of the printed image.

U.S. Pat. No. 6,151,044 discloses the use of a wiper blade for cleaning a nozzle plate of an ink jet print head. However, there is a problem with this method in that dirt or contaminants may not be removed from a nozzle plate that contains recesses which could trap contaminants. In addition, repeated wiping may cause excessive wear of the nozzle plate. Also, the action of wiping may push contaminants into the nozzles.

U.S. Pat. No. 6,145,952 discloses the use of hydrodynamic flushing of a surface of a nozzle plate of an ink jet print head which contains contaminants. However, there is a problem with this method in that dirt or contaminants may not be removed from a nozzle plate that contains recesses which could trap contaminants and also some contaminants may remain because they are strongly adhered to the surface.

It is an object of this invention to provide a method for cleaning a nozzle head of an ink jet print head which will remove substantially all of the contaminants from the surface of a nozzle plate of an ink jet print head which will improve its performance.

SUMMARY OF THE INVENTION

These and other objects are achieved in accordance with this invention comprising a method for removing contaminants from an ink jet print head having a nozzle plate with a plurality of nozzles, the method comprising:

a) applying a heat-activatable adhesive material over the surface of the nozzle plate having contaminants on the surface thereof;

b) applying heat to the heat-activatable adhesive material to cause it to flow over the surface of the nozzle plate having contaminants on the surface thereof, thereby causing the contaminants to adhere to the heat-activatable adhesive material; and d) removing the heat-activatable adhesive material having the contaminants adhered thereto.

By use of the invention, contaminants are conveniently and easily removed from the surface of a nozzle plate of an ink jet print head, thereby improving its performance.

BRIEF DESCRIPTION OF DRAWINGS

The drawing in FIG. 1 illustrates a cross section of a nozzle plate 10, for an ink jet print head containing contaminants and adhesive material.

DETAILED DESCRIPTION OF THE PREFERRED EMBODIMENTS

Figure 1:
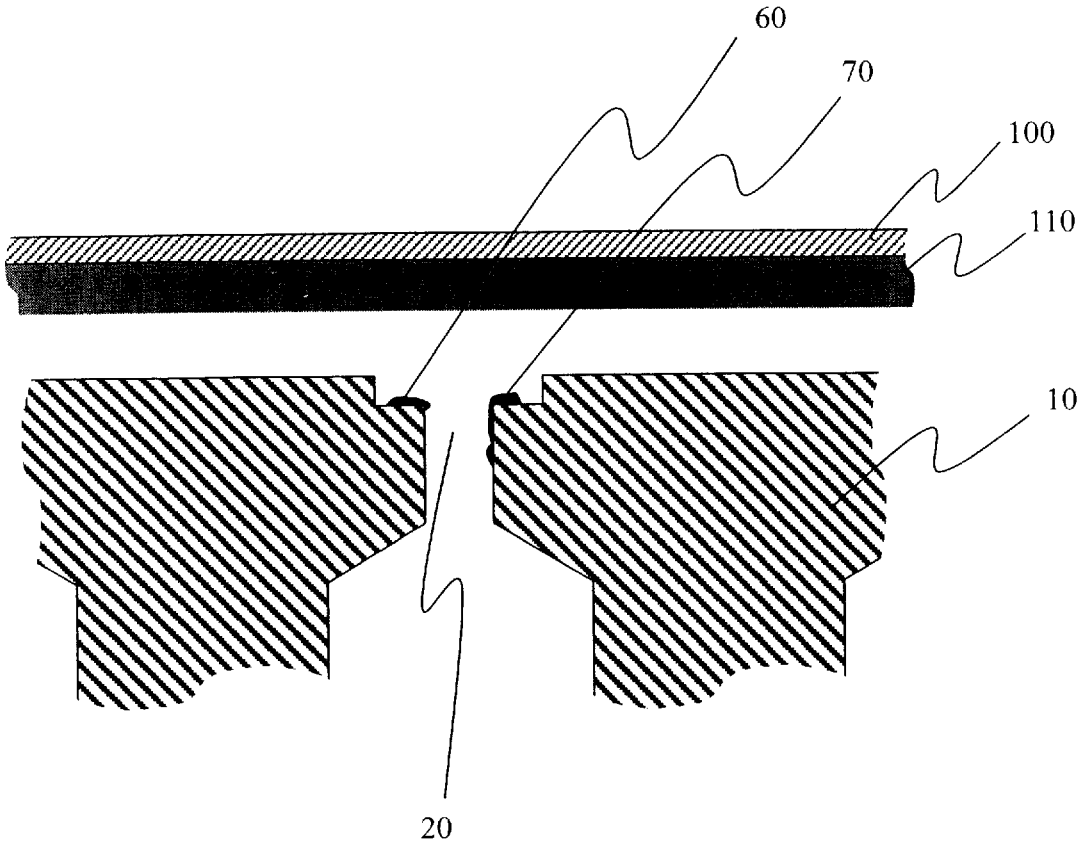

A nozzle plate for an ink jet print head preferably comprises silicon having an array of orifices through which ink is ejected. The orifices may be prepared by conventional etching techniques. The nozzle plate may also have a metallic oxide or nitride coating. It should be appreciated that other materials besides silicon, such as electro-formed nickel or polyimide, may be used to prepare the underlying nozzle plate as is known in the art. Further, other metals such as gold, silver, palladium and copper may be used to coat the underlying nozzle plate material. As noted above, the ink jet print head employed has multiple nozzles on the nozzle plate.

The heat-activatable adhesive material which may be used in the invention may be a hot-melt adhesive, such as a butyl rubber, nitrile rubber, styrene butadiene rubber adhesive, styrene-isoprene-styrene copolymer, ethylene acrylate copolymer, acrylic adhesive, polyolefin, poly(ethyl vinyl acetate), polyethylene adipate, a polyester or a polyamide and other related adhesives. Other materials that may be used include a thermal-curable or photo-curable material, such as epoxy formulations, isocyanate/bisphenol and isocyanate/bisamine formulations, polyimides or Novalac® resins; or a thermally reversible polymer gel, such as N-alkyl-substituted acrylamide polymers and copolymers or graft copolymers of N-alkyl-substituted acrylamides. Such materials can be combined with known tackifier and plasticizer materials to obtain the desired level of adhesion and cohesion.

In preferred embodiment of the invention, the heat-activatable adhesive material is a thermally reversible polymer gel comprising tri-block copolymers of poly(methyl methacrylate)-b-poly(n-butyl acrylate)-b-poly(methyl methacrylate) (PMMA-PBA-PMMA). It may be employed at a concentration of 3%-40% in a suitable solvent, such as ethanol, propanol, iso-propanol, n-butanol or 2-ethylhexanol. A thermally reversible polymer formulation forms a polymer gel at room temperature with a Young's modulus as low as $2.5\times10^3$ Pa (Mowery, C. L. et. al. "Adhesion of Thermally Reversible Gels to Solid Surfaces", Langmuir, 1997, 13, 6101). At an elevated temperature, e.g., 70° C., the gel melts and the material behaves as a viscous liquid with a typical complex viscosity of about 10 Pa·s at 1 Hz. When the material at the elevated temperature is cooled, gelation occurs very rapidly, forming a gel again. The adhesive characteristics of the gel are disclosed in the reference provided above.

In another preferred embodiment of the invention, a thermal- or photo-initiated crosslinking agent is added to the thermally reversible gel to make it thermally- or photo-curable. After curing, the gel forms a more robust material with improved mechanical strength which affords better peeling from the nozzle plate.

Examples of thermal- or photo-initiated crosslinking agents which may be used include ethylenically unsaturated organic compounds which are radiation or thermal curable materials. These compounds contain at least one terminal ethylene group per molecule and are typically liquids. In a preferred embodiment of the invention, polyethylenically unsaturated compounds having two or more terminal ethylene groups per molecule are employed, such as ethylenically unsaturated acid esters of polyhydric alcohols, e.g., trimethylolpropane triacrylate, pentaerythritol triacrylate or dipentaerythritol hydroxypentaacrylate.

Thermal initiators which are used in the thermal-curable, heat-activatable, adhesive material employed in the invention are disclosed, for example, in "Polymer Handbook", edited by J. Brandrup, E. H. Immergut, 3rd edition, Wiley-Interscience, section II/1-II/59, the disclosure of which is hereby incorporated by reference.

Photo-initiators which are used in the photo-curable, heat-activatable, adhesive material employed in the invention are disclosed, for example, in Polymer Engineering and Science, 1983,23,1022, and U.S. Pat. Nos. 4,366,228; 4,743,528; 4,743,529; 4,743,530; 4,743,531; 4,772,541; and 5,151,520, the disclosures of which are hereby incorporated by reference.

Light sources useful for photo-curable, heat-activatable, adhesive materials useful in the invention include conventional lamps, light-emitting devices, lasers, or light which may be delivered directly, and or through fiber optics.

There are many ways to apply heat to the heat-activatable, adhesive material. For example, heat may be applied by placing the nozzle plate in an oven, using a heating lamp, hot air gun, etc.

The heat-activatable, adhesive material can be applied over the surface of the nozzle plate by various methods including spreading with an applicator, spraying, lamination, etc. In a preferred embodiment, the heat-activatable, adhesive material is applied to a support forming a tape. The tape then can be conveniently applied to the surface of the nozzle plate, heating applied as described above, and the tape is then pulled off the surface.

DETAILED DESCRIPTION OF DRAWINGS

The drawing in FIG. 1 illustrates a cross section of a nozzle plate 10, for an inkjet print head. The nozzle plate has a number of orifices, 20, through which ink is ejected onto a recording element, not shown. Contaminants 60 and 70 are located on the surface of the nozzle plate and in the orifice, respectively. Adhesive 110 is carried by a support 100.

Figure 2:
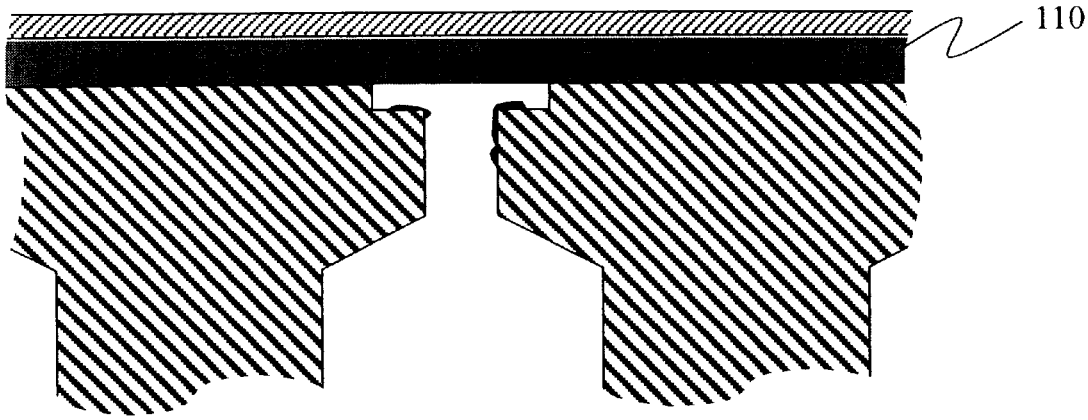
FIG. 2 illustrates the adhesive in contact with the nozzle plate.

FIG. 2 illustrates the adhesive layer 110 in contact with the contaminated nozzle plate.

Figure 3:
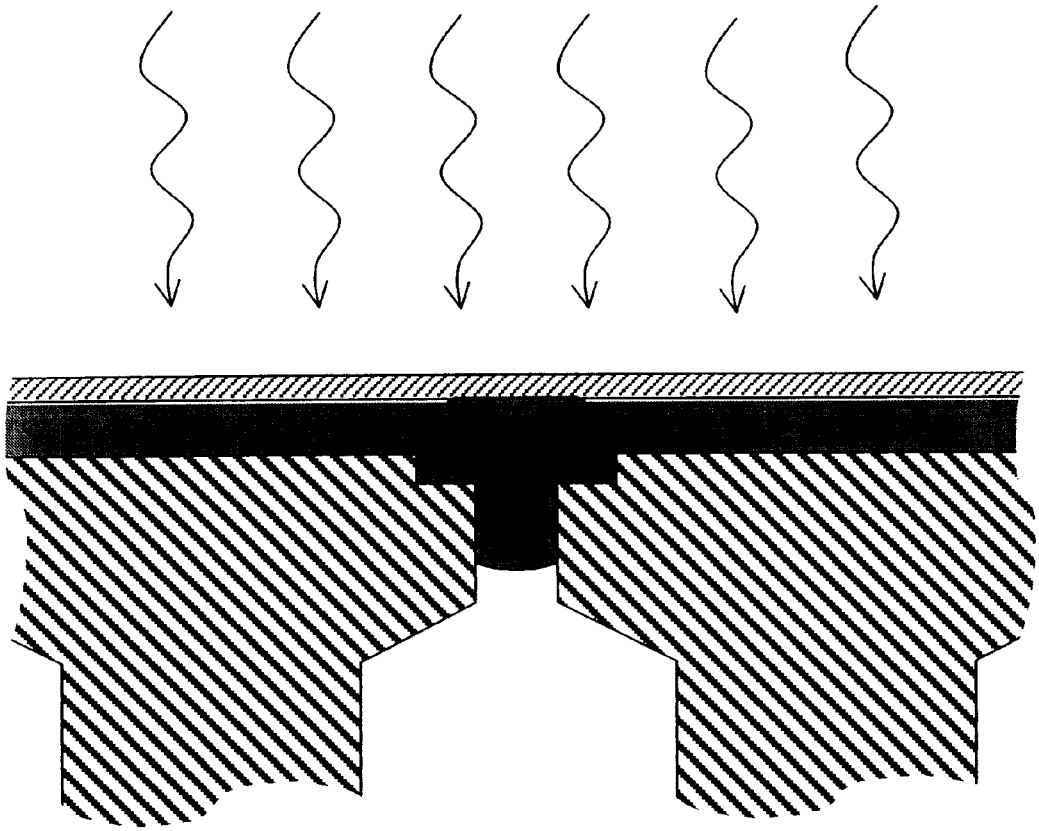
FIG. 3 illustrates heat being applied.

FIG. 3 illustrates heat being applied to the adhesive layer, causing it to flow and encompass the contaminants.

Figure 4:
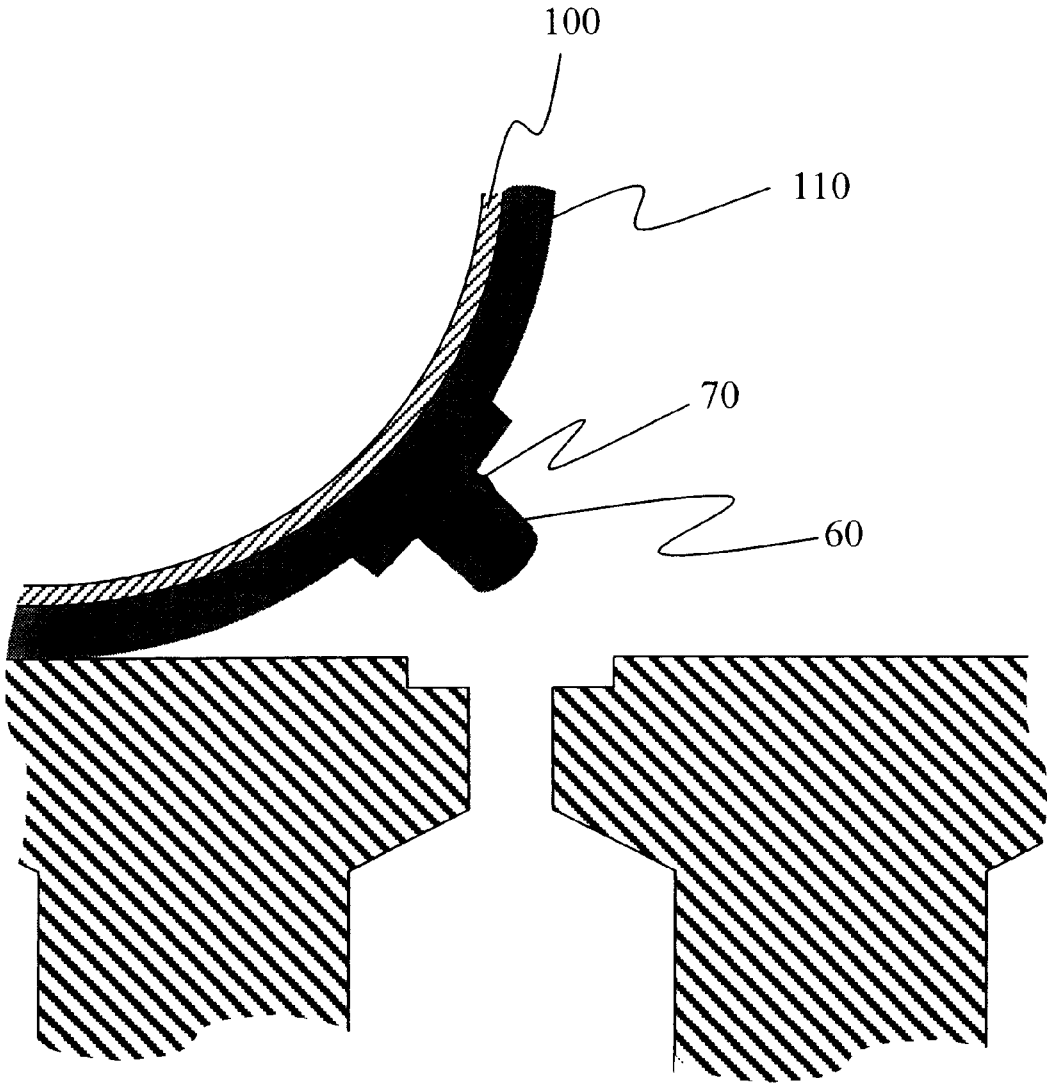
FIG. 4 illustrates the adhesive being peeled away from the nozzle plate carrying the contaminates with it.

FIG. 4 illustrates the adhesive being peeled from the surface of the nozzle plate taking the contaminants with it.

The following examples illustrate the utility of the present invention.

EXAMPLES

Example 1

Preparation of Thermally Reversible Gel 2 g of tri-block copolymer of PMMA-PBA-PMMA with a weight averaged molecular weight, Mw, of 158,000 and the Mw for the midblock of 103,000 is dissolved in 10 g iso-propanol at 70° C. When the solution is cooled down to room temperature, it forms an opaque gel. The gel melts to liquid when heated to above 65° C. and becomes a gel when cooled down.

Example 2

Preparation of Thermally Reversible and Curable Gel

The PMMA-PBA-PMMA of Example 1 is dissolved in a thermal crosslinking agent, 1 g trimethylolpropane triacrylate, Sartomer® SR351, (Sartomer Co.) and 9 g iso-propanol at 70° C. The solution forms a gel when cooled down to room temperature, and the gel melts at about 65° C. When the temperature is raised to 70° C., the polymer solution was degassed and 10 mg of benzoyl peroxide are added to the solution. The mixture is kept at about 60° C. for 2 hours, and forms a white rubber-like solid. The solid does not melt at temperatures above 70° C., and is not dissolvable in iso-propanol at 70° C.

Example 3

Cleaning Nozzle Plate

Artificial dirt slurry consisting of sub-micron sized aluminum oxide and silica particle, paper fiber, copper phthalocyanine sulfonate tetrasodium salt, and water is applied to a test surface and baked at 120° C. for 4 hours to prepare a "contaminated" surface. The test surface representing a nozzle plate is a piece of silicon wafer having a native oxide layer. The adhesive material of Example 1 is applied to the contaminated surface and heated to 70° C. causing the adhesive material to flow. The test surface was then cooled to room temperature causing the adhesive material to solidify. The solid gel was then peeled off the contaminated surface and the surface examined under a microscope. It was found that 99% of the dirt was removed where the gel had been applied.

Similar results were obtained using the adhesive material of Example 2.

Although the invention has been described in detail with reference to certain preferred embodiments for the purpose of illustration, it is to be understood that variations and modifications can be made by those skilled in the art without departing from the spirit and scope of the invention.

What is claimed is:

1. A method for removing contaminants from an ink jet print head having a nozzle plate with a plurality of nozzles, said method comprising:

a) applying a heat-activatable adhesive material over the surface of said nozzle plate having contaminants on the surface thereof;

b) applying heat to said heat-activatable adhesive material to cause it to flow over the surface and recesses of said nozzle plate having contaminants on the surface and recesses thereof, thereby causing said contaminants to adhere to said heat-activatable adhesive material; and c) removing said heat-activatable adhesive material having said contaminants adhered thereto, said heat-activatable adhesive material being a thermally reversible polymer gel;

said heat-activatable material comprising a thermally reversible polymer gel of a ti-i-block copolymer of poly(methyl methacrylate)-b-poly(n-butyl acrylate)-b-poly(methyl methacrylate).

2. The method of claim 1 wherein pressure is also applied to said heat-activatable adhesive material.

3. The method of claim 1 wherein said heat-activatable material contains an organic solvent.

4. The method of claim 1 wherein said heat-activatable material also comprises a thermal-curable or photo-curable material.

5. The method of claim 4 wherein said heat-activatable material also contains a cross-linking agent.

6. The method of claim 1 wherein said heat-activatable adhesive material is carried by a support which forms a tape which is then applied over the surface of said nozzle plate having contaminants on the surface thereof, and the removal of said heat-activatable adhesive material having said contaminants adhered thereto is accomplished by peeling off said tape from said nozzle plate.

* * * * *